US007753356B2

(12) United States Patent
Rowe et al.

(10) Patent No.: US 7,753,356 B2
(45) Date of Patent: Jul. 13, 2010

(54) LOCKING MECHANISM FOR AN IMAGE FORMING DEVICE

(75) Inventors: Jason Lee Rowe, Richmond, KY (US); Thom Jer Magdadaro Bacalso, Cebu (PH); Rommel Cabanet Balala, Lapu-Lapu (PH)

(73) Assignee: Lexmark International, Inc., Lexington, KY (US)

( * ) Notice: Subject to any disclaimer, the term of this patent is extended or adjusted under 35 U.S.C. 154(b) by 260 days.

(21) Appl. No.: 11/834,747

(22) Filed: Aug. 7, 2007

(65) Prior Publication Data

US 2009/0038350 A1 Feb. 12, 2009

(51) Int. Cl.
*B65H 3/44* (2006.01)

(52) U.S. Cl. ..... 271/9.11; 271/9.01

(58) Field of Classification Search ..... 271/9.01, 271/9.11

See application file for complete search history.

(56) References Cited

U.S. PATENT DOCUMENTS 5,307,116 A * 4/1994 Ikunami et al. ..... 399/18
2004/0264998 A1 * 12/2004 Uchida ..... 399/107

* cited by examiner

*Primary Examiner*—Patrick Mackey
*Assistant Examiner*—Michael C McCullough

(57) ABSTRACT

The present application is directed to methods and devices for a locking mechanism to connect input components for use within an image forming device. Two or more input components are placed in a stacked arrangement. The locking mechanism of a first input component engages the locking mechanism of a second input component to connect the input components. The locking mechanism may be activated automatically when the input units are stacked.

21 Claims, 6 Drawing Sheets

LOCKING MECHANISM FOR AN IMAGE FORMING DEVICE

BACKGROUND

The present application relates generally to image forming devices, and, more specifically, to methods and devices for automatically locking multiple input sources together.

Image forming devices move media sheets along a media path. The media sheets initially begin at an input area that is sized to hold a stack of sheets. Each sheet is picked from the stack and introduced into the media path. The media path comprises a series of roller nips, guides, and/or belts. The sheets move along the media path and through an imaging area where an image is transferred to the sheet. The media sheet is then either output from the device, or re-circulated through a duplex path for receiving an image on a second side.

Image forming devices may include multiple input sources to introduce the media sheets into the media path. The input sources may accommodate a variety of media types, and a range of media sheet quantities from a single media sheet to large quantities such as 2,000+ sheets. The image forming device typically includes at least one input source integrated into the structure of the device, such as removable tray that is configured to hold a stack of media sheets. The image forming device may also include a multipurpose feeder for transparencies, envelopes, card stock, and the like.

Image forming devices may also have the capability to add additional input sources to the device. These additional input sources may take the form of a module having generally the same length and width as the image forming device that connect to a bottom surface of the device. One or more additional input sources may be stacked together to provide the desired media selection. In addition, a base unit may be attached below the additional input sources. In order to maintain structural stability and to avoid tipping of the assembled image forming device and input sources, a locking mechanism may be used to connect one or more of the individual units.

SUMMARY

The present application is directed to methods and devices for a locking mechanism to connect input components for use within an image forming device. Two or more input components are placed in a stacked arrangement. The locking mechanism of a first input component engages the locking mechanism of a second input component to connect the input components. The locking mechanism may be activated automatically when the input units are stacked.

DETAILED DESCRIPTION

The present application is directed to methods and devices for a locking mechanism to connect input components for use within an image forming device. Two or more input components are placed in a stacked arrangement. In addition, the image forming device may be stacked on top of the input components. The locking mechanism of a first input component engages the locking mechanism of a second input component to connect the input components. The locking mechanism may be activated automatically when the input units are stacked.

Figure 1:
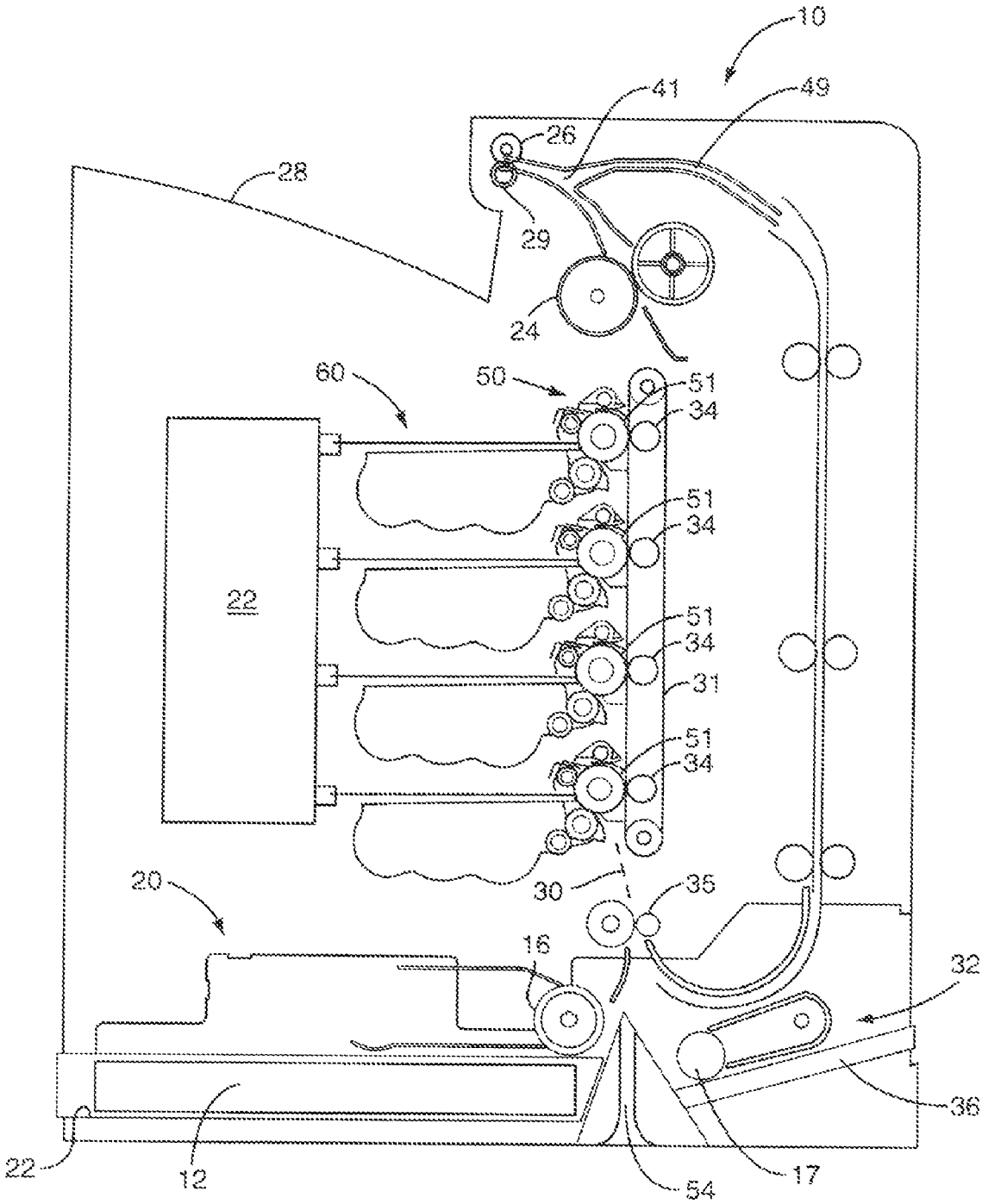
FIG. 1 is a schematic view of an image forming device according to one embodiment.
Figure 2:
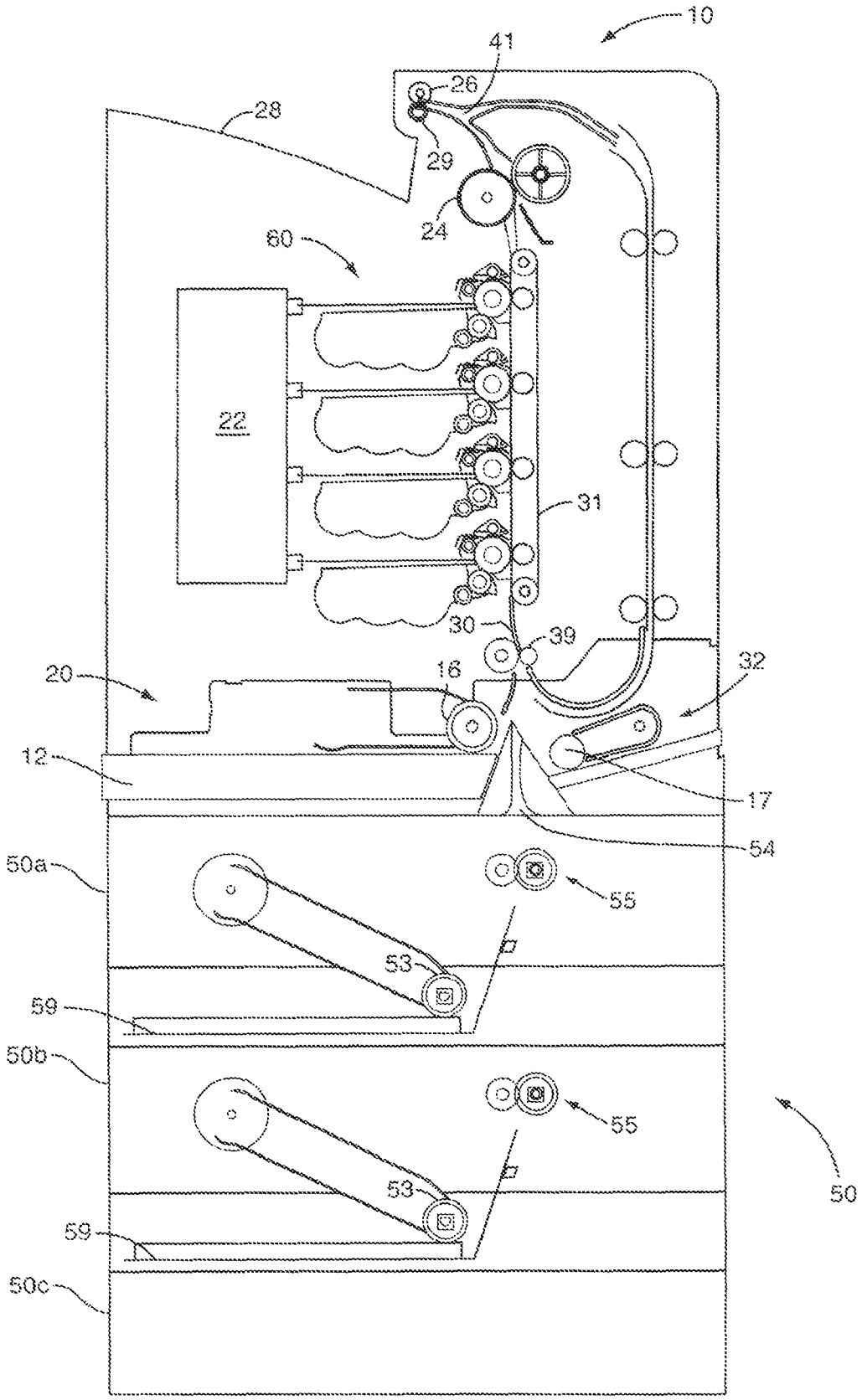
FIG. 2 is a schematic view of an image forming device with multiple media input units according to one embodiment.

The locking mechanism will be better understood in the context of the image forming device illustrated in FIGS. 1 and 2. FIG. 1 illustrates a representative image forming device 10. A primary input area 20 includes an input tray 22 to receive a stack of media sheets 12. A contact roller 16 may be positioned adjacent to the input tray 22 to contact and introduce the media sheets 12 into a media path 30. The input area 20 may also include a multipurpose feeder 32. The multipurpose feeder 32 may include a support surface 36 to support one or more media sheets 12, and a contact roller 17 to contact and move the media sheets 12 into a media path 30.

Media sheets 12 are moved from the input area 20 and fed into the media path 30. One or more registration rollers 35 align the media sheets 12 and precisely control its further movement along the media path 30. A media transport belt 31 forms a section of the media path 30 for moving the media sheets 12 past a plurality of image forming units 60. Color printers typically include four image forming units 60 for printing with cyan, magenta, yellow, and black toner to produce a four-color image on the media sheet 12.

An imaging device 22 forms an electrical charge on a photoconductive member within the image forming units 60 as part of the image formation process. The media sheet 12 with loose toner is then moved through a fuser 24 that adheres the toner to the media sheet 12. An exit roll 26 forming a nip with a nip roll 29 is positioned at an output area. The exit roll 26 rotates in a forward direction to expel the media sheet 12 from the device 10 and out to an output tray 28. Alternatively, the exit roll 26 may rotate in a forward direction for a limited time until a trailing edge of the media sheet 12 passes an intersection point 41 along the media path 30. The exit roll 26 is then rotated in a reverse direction to drive the media sheet 12 into a duplex path 49. The duplex path 49 directs the inverted media sheet 12 back through the image formation process for forming an image on a second side of the media sheet 12.

FIG. 2 illustrates the image forming device of FIG. 1 including several input components 50. In this embodiment, a first input component 50*a* and a second input component 50*b* function as media handling units and feed media sheets 12 to the image forming device 10. Although two media handling input components 50*a*, 50*b* are illustrated, it is understood to those skilled in the art that more than two media handling input components 50*a*, 50*b* may be combined, and that each may handle a different type of media. For example, input component 50*a* may handle 8½"×11" plain paper, and input component 50*b* may handle 8½"×14" paper. Each of the input components 50*a*, 50*b* may include a pick mechanism 53 that picks sheets from input area 59. In one embodiment, the input area 59 is a tray and has a larger capacity than the primary input source 20 to hold a greater number of sheets. Feed rollers 55 are located downstream from the pick mechanism 53 to receive the sheets and forward them through an input path 54 towards the media path 30.

In addition to media handling units, the input components 50 may serve other functions such as a storage area, a base unit to increase the overall height of the image forming device, or a base unit with castors or wheels to facilitate relocation of the image forming device. FIG. 2 illustrates a third input component in the form of a base unit 50*c* below the second input component 50*b*.

Figure 3:
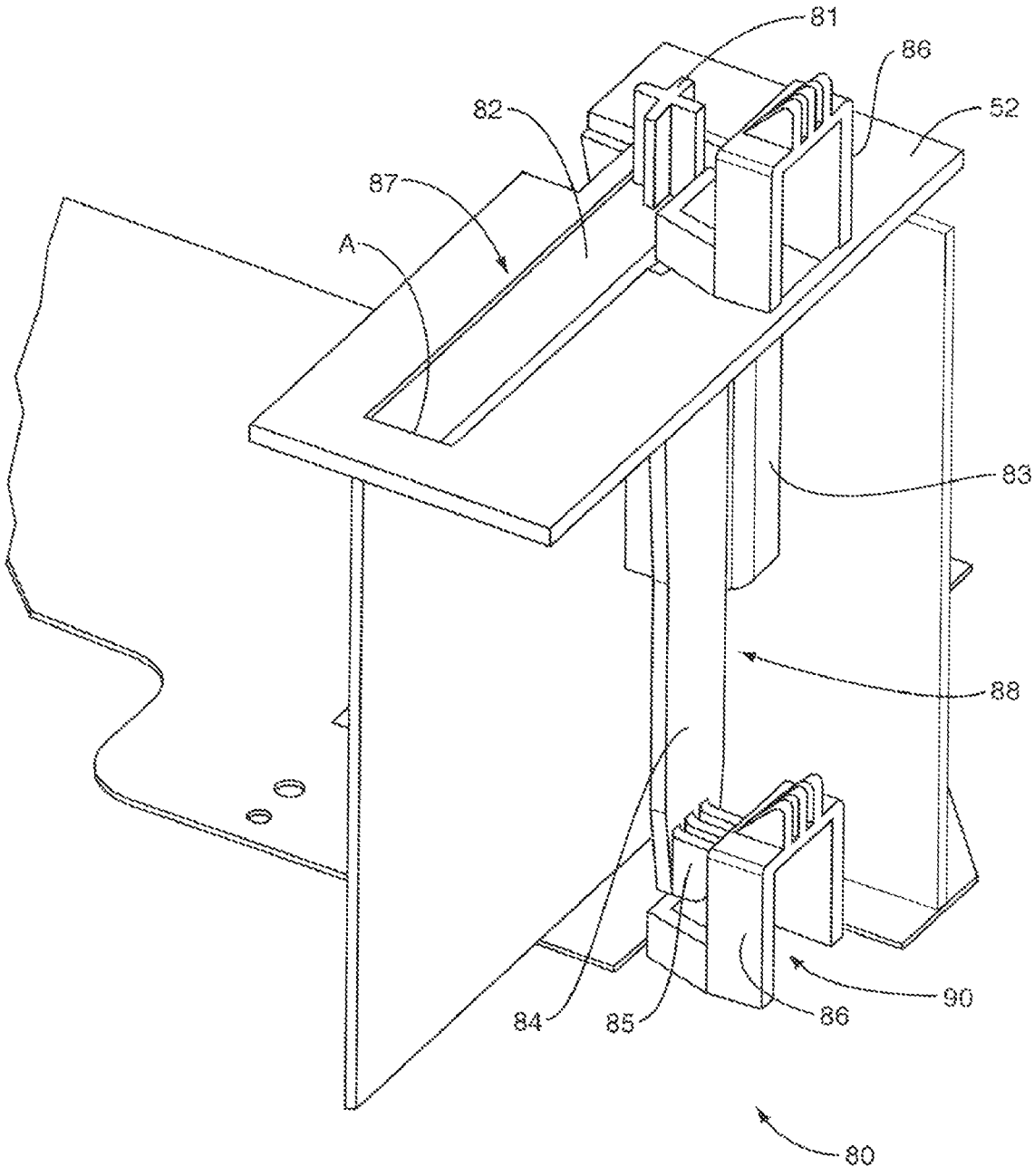
FIG. 3 is a perspective view of a locking mechanism according to one embodiment.

FIG. 3 illustrates the positioning of the elements of one embodiment of the locking mechanism 80 when two input components 50*a*, 50*b* are placed in a stacked arrangement as illustrated in FIG. 2. In this embodiment, the locking mechanism 80 includes a cam mechanism positioned within the first input component 50*a* and a receiver 86 positioned on an upper surface 52 of the second input component 50*b*. Note that FIG. 3 also illustrates a second receiver 86 located in the upper portion of the figure and positioned on the upper surface 52 of the first input component 50*a*. The second receiver 86 would be used if another input component 50 (not shown) were stacked on the first input component 50*a*.

Figure 4:
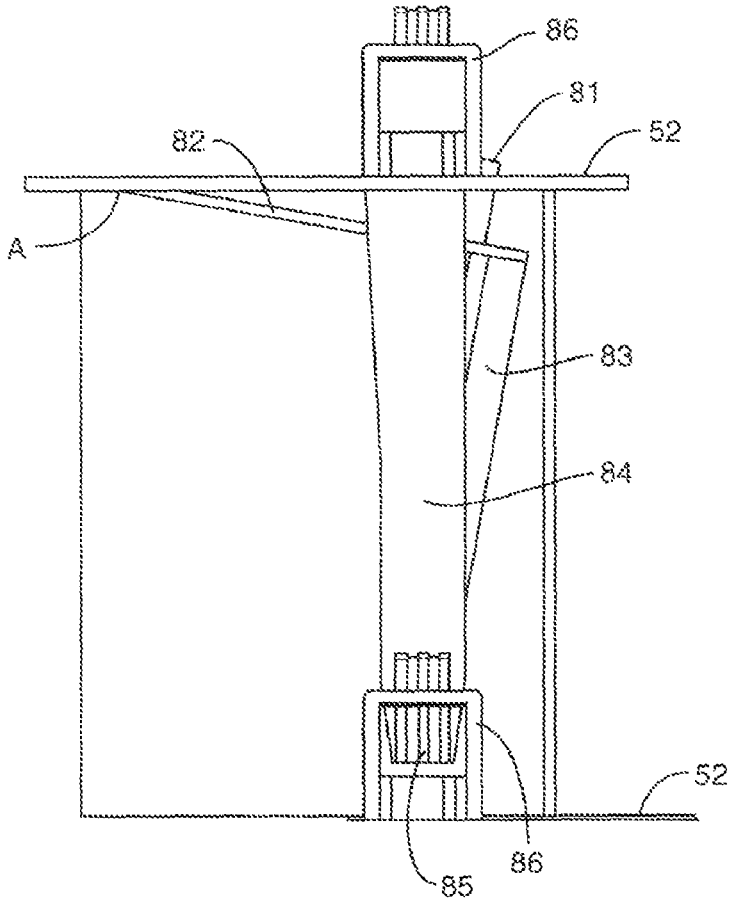
FIG. 4 is a front view of a locking mechanism according to one embodiment.

The cam mechanism includes a hook activator 87 and a hook arm 88. The hook activator 87 includes a top arm 82 and a lower arm 83. The top arm 82 is biased in a position generally parallel to and flush with the upper surface 52 of the input component 50*a*. In one embodiment, the hook activator 87 is integrally formed with the upper surface 52. The hook activator 87 and the upper surface 52 may be constructed of a resilient material which biases the hook activator 87 in the position flush with the upper surface 52. In another embodiment, a spring (not shown) maintains the hook activator 87 in the biased position, although other biasing structures and/or components know in the art are also contemplated. A first end of the top arm is pivotably attached to the upper surface 52 at point A. Extending upward in relation to the upper surface 52 from an opposite end of the top arm 82 from point A is a contact button 81. The lower arm 83 extends downward in relation to the top surface 52 from the end of the top arm 82 that includes the contact button 81. Thus, the top arm 82 and the lower arm 83 form an L-shape. When a force is applied to the contact button 81, the hook activator 87 pivots in a first direction about point A as illustrated in FIG. 4.

Figure 5:
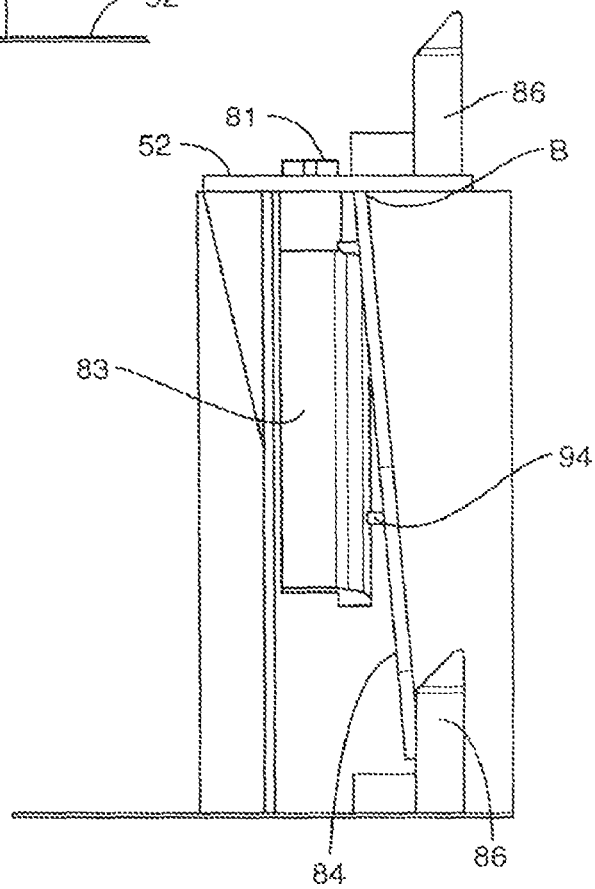
FIG. 5 is a side view of a locking mechanism according to one embodiment.

A top end of the hook arm 88 as illustrated in FIG. 5 is pivotably attached to the upper surface 52 at point B. An arm portion 84 of the hook arm 88 extends downward from the upper surface 52. Prior to the locking mechanism 80 being activated, the arm portion 84 is generally parallel to the lower arm 83 of the hook activator 87. Located at a lower end of the arm portion 84 is a hook member 85. The hook member 85 extends essentially outward from the arm portion 84. A tab 94 extends outward from a side of the arm portion opposite that of the hook member 85. The tab 94 extends outward a distance sufficient to extend into the pivot path of the hook activator 87. When the hook activator 87 pivots, the lower arm 83 makes contact with the tab 94 of the hook arm 88. This contact causes the hook arm 88 to pivot about point B in a second direction as illustrated in FIG. 5, the second direction being generally perpendicular to the first direction of the hook activator 87. The pivoting movement of the hook arm 88 moves the hook member 85 laterally outward.

Similar to the previous discussion of the hook activator 87, the hook arm 88 may also be integrally formed with the upper surface 52 (or another part of the input component 50). The hook arm 88 and the upper surface 52 may be constructed of a resilient material which may bias the hook arm 88 in an unlocked position as shown in FIG. 3. In another embodiment, a spring (not shown) maintains the hook arm 88 in the unlocked position although other biasing structures and/or components know in the art are also contemplated.

The receiver 86 is located on the top surface 52 of each input unit 50. In one embodiment, the receiver 86 has an inverted U-shape and extends upward from the upper surface 52 defining an open space 90 within the U-shape. When the first input source 50*a* is stacked on top of the second input source 50*b*, the hook member 85 of the first input source 50*a* aligns with the receiver 86 of the second input source 50*b*. The receiver is positioned such that the open space 90 is oriented toward the hook member 85. As the hook member 85 extends laterally outward, the hook member 85 moves into the open space 90 and engages the receiver 86. The engagement of the hook member 85 and the receiver 86 lock the first input source 50*a* and the second input source 50*b* together.

Figure 6:
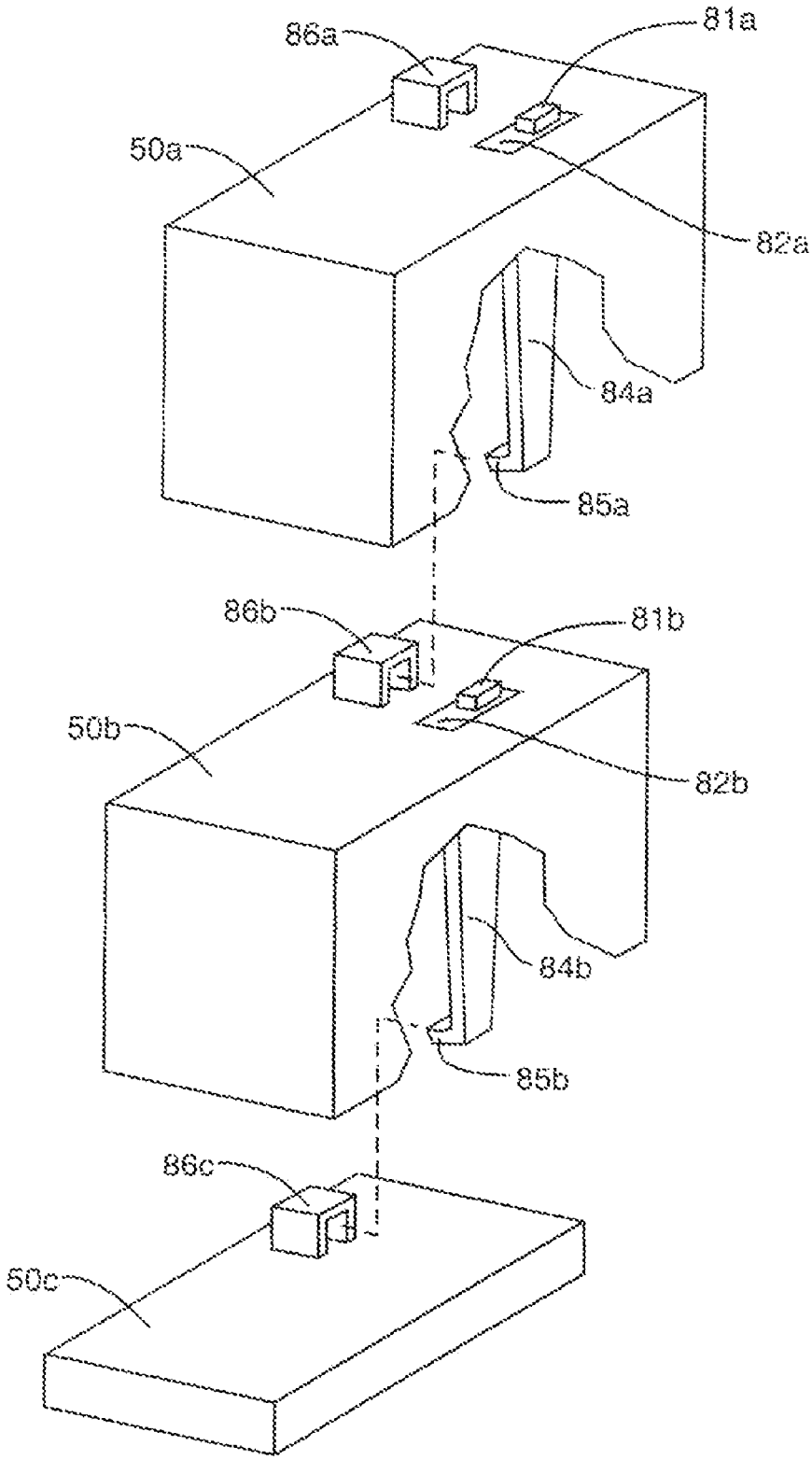
FIG. 6 is an exploded perspective view of two media input units and a base unit according to one embodiment.

As illustrated in FIG. 6, the receiver 86 may be positioned on an upper surface of an input component 50*c* that is not a media handling unit, such as the storage and base units described above. These base unit input components 50*c* are typically the last unit (i.e., the vertically lowest component) in the stack. Thus, they do not include the cam mechanism illustrated in FIG. 3. The cam mechanism of the input component 50*b* engages the receiver 86 on the base unit input component 50*c*, further locking the input components 50*a*-*c* into a unified structure.

Operation of an embodiment of the locking mechanism 80 for an image forming device 10 including a base unit 50*c* and two input components 50*a*, 50*b* is illustrated in FIG. 6. The base unit 70 is first placed on a support surface such as a floor or a table. Extending upward from an upper surface of the base unit 50*c* is the receiver 86*c*. Next, the second input source 50*b* is placed on top of the base unit 50*c*. The arm portion 84*b* and hook member 85*b* of the second input component 50*b* are aligned with the receiver 86*c* of the base unit 50*c*. In this alignment, the hook member 85*b* is positioned in front of the open space 90 of the receiver 86*c*, but is not yet engaged with the receiver 86*c*. At this point, the second input unit 50*b* and the base unit 50*c* are not locked together.

The first input component 50*a* is then placed on top of the second input component 50*b* As the two input components 50*a*, 50*b* are joined, a lower surface of the first input component 50*a* makes contact with the contact button 81*b* of the second input component 50*b*. The top arm 82*b* pivots downward causing the lower arm 83*b* (not shown in FIG. 6) to contact the arm portion 84*b*. The arm portion 84*b* then pivots, moving the hook member 85*b* into the open space 90 of the receiver 86*c*. At this point, the second input component 50*b* and the base unit 50*c* are locked together.

Next, the image forming device 10 (not shown in FIG. 6) is placed on top of the first input component 50*a*. A bottom surface of the image forming device 10 makes contact with the contact button 81*a* of the first input component 50*a*. The top arm 82*a* pivots downward causing the lower arm 83*a* (not shown in FIG. 6) to contact the arm portion 84*a*. The arm portion 84*a* then pivots, moving the hook member 85*b* into the open space 90 of the receiver 86*b*. At this point, the first input component 50*a*, the second input component 50*b*, and the base unit 50*c* are all locked together forming a unified structure.

Figure 7:
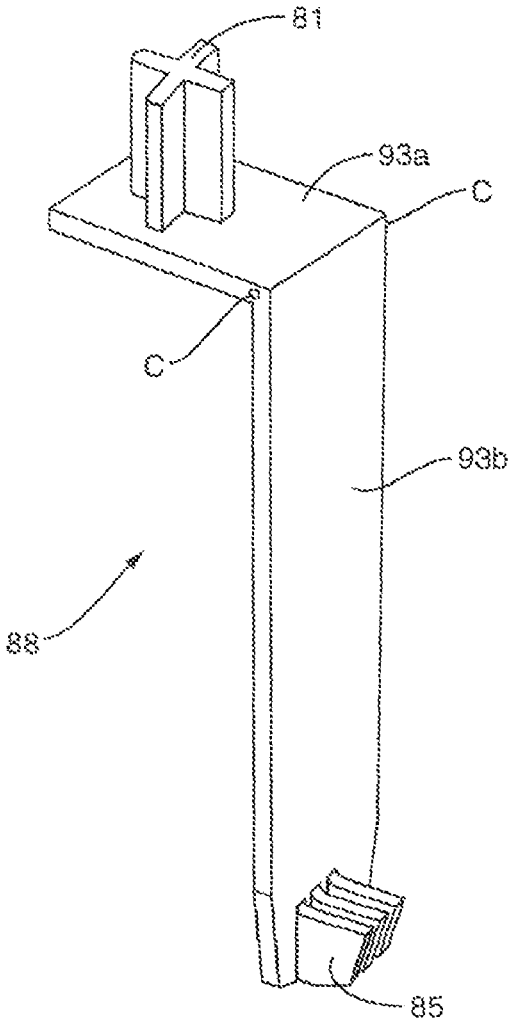
FIG. 7 is a perspective view of a portion of a locking mechanism according to one embodiment.

An alternate embodiment of a portion of the locking mechanism 80 is illustrated in FIG. 7. In this embodiment, the hook activator and hook arm are combined into a single hook arm 88. The hook arm 88 includes a first arm 93*a* with a second arm 93*b* extending essentially perpendicular from a first end of the first arm 93*a*, forming an L-shape. A contact button 81 is connected adjacent to a second end of the first arm 93*a*, extending upward in a generally opposite direction from the second arm 93*b*. Attached to an end of the second arm 93*b* opposite from the first arm 93*a* is a hook member 85. The hook member 85 extends essentially perpendicularly outward from the second arm 84*b* in a direction opposite that of the first arm 84*a*.

The hook arm 88 is pivotably connected to the upper surface 52 of the input component 50 at points C. Operation of the embodiment illustrated in FIG. 7 is similar to that described above. The contact button 81 extends upward form the top surface 52 of the input component 50. The contact button 81 is pressed downward causing the hook arm 88 to pivot about points C. As the hook arm 88 pivots, the hook member 85 moves laterally outward and engages a receiver 86.

Figure 8:
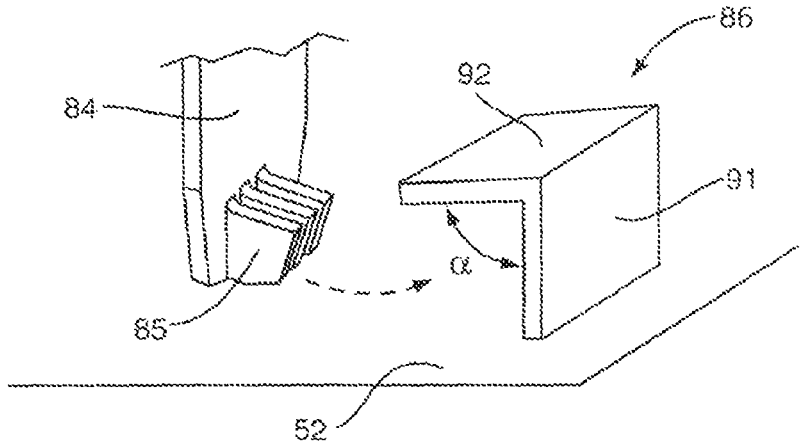
FIG. 8 is a perspective view of a portion of a locking mechanism according to one embodiment.

FIG. 8 illustrates an embodiment of the receiver 86 including a side wall 91 extending upward from the upper surface 52 of the input component 50. Extending at an angle $\alpha$ from a top edge of the side wall 91 is a top wall 92. In one embodiment, the angle $\alpha$ is less than or equal to 90 degrees. The receiver 86 is oriented such that the side wall 91 is generally parallel to the arm portion 84 of the hook arm 88, and the top wall 92 extends generally towards the arm portion 84. In this orientation, as the hook arm 88 pivots as shown by the arrow in FIG. 8, the hook member 85 engages an underside of the top wall 92.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A locking mechanism for connecting a first input component and a second input component for use with an image forming device, the first input component including a tray sized to receive a stack of media sheets; the locking mechanism comprising:

an arm attached to the first input component, the arm movable from a first position to a second position;

a contact button attached to the arm, positioned to extend above the tray of the first input component and movable within the first input component in response to the image forming device being placed on top of the first input component;

a hook movable between unlocked and locked positions; and a receiver attached to the second input component, and positioned in proximity to the hook when the first input component is stacked onto the second input component;

movement of the arm from the first position to the second position responsive to deflection of the contact button causes the hook to move from the unlocked position that is spaced away from the receiver to the locked position that engages the receiver to prevent relative movement between the stacked first and second input components.

2. The locking mechanism of claim 1, wherein the hook is connected to a first end of the arm and the contact button is connected to the arm in proximity to a second end of the arm.

3. The locking mechanism of claim 1, wherein the arm is pivotably attached to the first input component and pivots from the first position to the second position along a first axis, and the hook pivots between the locked and unlocked positions along a second axis different from the first axis.

4. The locking mechanism of claim 3, wherein the first and second pivot axes are substantially perpendicular to each other.

5. The locking member of claim 1, wherein the first input component includes a support surface for receiving the image forming device, and the contact button extends above the support surface.

6. The locking mechanism of claim 1, wherein a second end of the arm is positioned in proximity to an upper surface of the first input component and a first end of the arm is positioned in proximity to a lower surface of the first input component.

7. The locking mechanism of claim 1, wherein the receiver includes an opening configured to accept the hook therein.

8. The locking mechanism of claim 1, wherein the arm moves between the first and second positions in an absence of electrical power being provided to the first input component.

9. A locking mechanism for connecting a first input component and a second input component for use with an image forming device, the first input component including a tray sized to receive a stack of media sheets; the locking mechanism comprising:

a first arm connected to the first input component, the first arm moveable along a first path from a first position to a second position;

a second arm connected at a first end to the first input component, the second arm moveable along a second path from a first position to a second position, wherein the first path is generally perpendicular to the second path;

a contact button connected to the first arm in proximity to a first end of the first arm and positioned to extend above the tray of the first input component;

a hook connected to a second end of the second arm, and adapted to move between unlocked and locked positions; and a receiver attached to the second input component, and positioned in proximity to the hook when the first input component is stacked onto the second input component;

movement of the second arm to the second position in response to movement of the first arm to the second position causes the hook to move from the unlocked position that is spaced away from the receiver to the locked position that engages the receiver to prevent relative movement between the stacked first and second input components.

10. The locking mechanism of claim 9, wherein the first arm moves from the first position to the second position along the first path in response to a force applied to the contact button.

11. The locking mechanism of claim 10, wherein the hook remains engaged with the receiver as long as the force is applied to the contact button, the force is applied to the contact button responsive to the image forming device being stacked on top of the first input component.

12. The locking mechanism of claim 9, wherein at least a portion of the second arm is positioned within the first path when the second arm is in the first position along the second path.

13. The locking mechanism of claim 12, wherein a second end of the first arm contacts the second arm when the first arm moves from the first position to the second position along the first path.

14. The locking mechanism of claim 13, wherein the contact between the first arm and the second arm causes the second arm to move from the first position to the second position along the first path.

15. The locking mechanism of claim 14, wherein the first and second arms remain in contact when the second arm moves from the first position to the second position along the second path.

16. The locking mechanism of claim 9, wherein the first arm pivots about a first axis and the second arm pivots along a second axis different from the first axis.

17. A locking mechanism for securing an input component in a vertical stack of components including an image forming device, the input component including an input tray for receiving media sheets, the locking mechanism comprising:

an arm attached to the input component, the arm pivots from a first position to a second position about a first axis;

a contact button attached to the arm, positioned to extend above an upper portion of the input component and movably deflects within the input component responsive to placement of the input component in the stack of components so to cause movement of the arm from the first position to the second position; and a hook movable between unlocked and locked positions, wherein the movement of the arm causes the hook to move from the unlocked position to the locked position for engaging with another component in the stack of components, in order to prevent relative movement between the input component and the other component in the stack of components.

18. The locking mechanism of claim 17, wherein the arm and the hook pivot along first and second pivot axes, respectively, that are different from each other.

19. The locking mechanism of claim 18, wherein the first and second axes are substantially perpendicular to each other.

20. The locking mechanism of claim 17, wherein the hook is connected to a first end of the arm and the contact button is connected to the arm in proximity to a second end of the arm.

21. The locking mechanism of claim 17, wherein the other component is a component in the stack of components immediately below the input component, and the locking mechanism further includes a receiver disposed on the input component for engaging in a locked arrangement with a component immediately above the input component in the stack of components.

* * * * *